US009241524B2

(12) United States Patent
Burchard

(10) Patent No.: US 9,241,524 B2
(45) Date of Patent: Jan. 26, 2016

(54) HAIR EXTENSION SYSTEM

(71) Applicant: Michael Burchard, Santa Monica, CA (US)

(72) Inventor: Michael Burchard, Santa Monica, CA (US)

( * ) Notice: Subject to any disclaimer, the term of this patent is extended or adjusted under 35 U.S.C. 154(b) by 10 days.

(21) Appl. No.: 13/886,599

(22) Filed: May 3, 2013

(65) Prior Publication Data

US 2014/0034077 A1 Feb. 6, 2014

Related U.S. Application Data

(60) Provisional application No. 61/680,170, filed on Aug. 6, 2012.

(51) Int. Cl.
*A41G 5/00* (2006.01)

(52) U.S. Cl.
CPC ..... *A41G 5/0066* (2013.01); *A41G 5/004* (2013.01)

(58) Field of Classification Search
CPC ..... A41G 5/00; A41G 5/004; A41G 5/0066; A41G 5/0033; A41G 3/00; A41G 3/0025; A41G 3/0058; A41G 3/0041; A63H 3/44
USPC ..... 132/201, 53, 54
See application file for complete search history.

(56) References Cited

U.S. PATENT DOCUMENTS

| | | | | |
|---|---|---|---|---|
| 5,107,867 | A | 4/1992 | Barrington | |
| 5,894,846 | A | 4/1999 | Gang | |
| 6,405,736 | B2 * | 6/2002 | Townsend | 132/201 |
| 6,938,624 | B2 | 9/2005 | Arroyo | |
| 7,032,602 | B2 | 4/2006 | Chang | |
| 7,252,093 | B2 | 8/2007 | Rodriguez | |
| 7,458,383 | B2 | 12/2008 | Song | |
| 7,753,057 | B2 * | 7/2010 | Kallabat et al. | 132/201 |
| 7,992,576 | B2 | 8/2011 | Chang | |
| 8,360,075 | B2 * | 1/2013 | Winn | 132/201 |
| 2003/0075196 | A1 * | 4/2003 | Fair | 132/201 |
| 2004/0149301 | A1 | 8/2004 | Arroyo | |
| 2004/0149302 | A1 * | 8/2004 | Toda | 132/201 |
| 2005/0098190 | A1 * | 5/2005 | Kim | 132/201 |
| 2005/0194015 | A1 | 9/2005 | Watts | |
| 2006/0065280 | A1 | 3/2006 | Cheng | |
| 2006/0065281 | A1 | 3/2006 | Kim | |
| 2006/0180171 | A1 * | 8/2006 | Kim | 132/201 |
| 2007/0277839 | A1 * | 12/2007 | Rodriguez | 132/53 |
| 2008/0190442 | A1 * | 8/2008 | Kwak | 132/273 |
| 2008/0236605 | A1 * | 10/2008 | Russo | 132/201 |
| 2008/0257369 | A1 | 10/2008 | Poole | |
| 2008/0276949 | A1 * | 11/2008 | Lee | 132/53 |
| 2010/0000567 | A1 * | 1/2010 | Park | 132/274 |

(Continued)

*Primary Examiner* — Robyn Doan
*Assistant Examiner* — Tatiana Nobrega
(74) *Attorney, Agent, or Firm* — Buchalter Nemer

(57) ABSTRACT

Hair extensions are disclosed that include a weft and at least a single micro-cylinder, wherein the weft comprises a plurality of hair, a skin weft and at least a single i-tip. Hair extensions may also include a weft and at least a single micro-cylinder, wherein the weft comprises a plurality of hair, a skin weft and at least a single i-tip; wherein a top section of the plurality of hair is bonded together to form the skin weft and the at least single i-tip. Methods of attaching a hair extension, wherein the hair extension comprises a micro-cylinder, a plurality of hair, a skin weft and at least a single i-tip are also disclosed herein that include bonding the plurality of hair to form the skin weft and the at least a single i-tip; threading a segment of natural hair through the micro-cylinder; inserting the i-tip into the micro-cylinder; and crimping the micro-cylinder to secure the i-tip.

16 Claims, 5 Drawing Sheets

(56) References Cited

U.S. PATENT DOCUMENTS

| | | | | |
|---|---|---|---|---|
| 2010/0059079 | A1 | 3/2010 | Tokko | |
| 2011/0005543 | A1* | 1/2011 | Winn | 132/201 |
| 2011/0056507 | A1* | 3/2011 | Tokko | 132/201 |
| 2011/0079233 | A1* | 4/2011 | Cheh | 132/53 |
| 2011/0197908 | A1* | 8/2011 | Waters | 132/201 |
| 2011/0247643 | A1* | 10/2011 | Tokko | 132/201 |
| 2012/0067365 | A1* | 3/2012 | Brown | 132/201 |
| 2013/0032162 | A1* | 2/2013 | Major | 132/54 |
| 2013/0098380 | A1* | 4/2013 | Kim | 132/53 |

* cited by examiner

HAIR EXTENSION SYSTEM

This U.S. Utility Application claims the benefit of priority based on Provisional Application Ser. No. 61,680,170 filed on Aug. 6, 2012 and entitled "Hair Extension System with i-tip Weft Application That is Adjustable and Reusable", which is commonly-owned and incorporated in its entirety by reference.

FIELD OF THE SUBJECT MATTER

The field of the subject matter relates to hair extensions, and in particular, a hair extension system that is reusable and simple to apply and remove. It is achieved by a weft with i-tips that is secured to the user's natural hair with a pressure bond.

Contemplated embodiments, as disclosed herein, aim to improve upon what currently exists, in that they provide a better way of constructing and using hair extensions through a weft and attachment system comprised of a weft with a simple construction and an attachment.

BACKGROUND

Hair extensions are meant to lengthen or thicken a user's natural hair by incorporating artificial hair or natural hair. They are also meant to change the look and style of one's hair while maintaining a realistic appearance. Conventional hair extensions are affixed to a user's natural hair by devices and methods that may cause damage the user's natural hair. Furthermore, conventional hair extensions, because of the way they are affixed, may generally only be used once and cannot be reused.

Conventional hair extensions may be affixed to the user's natural hair through a variety of methods. The most common methods are glue or other forms of adhesive to attach the hair extension to the user's hair. While this is simple to use, the adhesives stick to the hair and upon removal could tear out existing pieces of the user's natural hair. Furthermore, adhesives also adhere to anything else that may be in the hair, including dirt, hair products and other things. Thus, the entire extension must be removed and cannot be easily reused.

Other conventional hair extensions include using a clip that is pressed into the user's natural hair. Clips are rather bulky and are easily visible. In addition, they also weigh down a user's natural hair.

Other conventional hair extensions use a tube in which hair is attached. The user's natural hair is placed through a cylinder and the tube is inserted and the cylinder is crimped over the tube in order to secure it. These conventional embodiments are limited by the amount of times the tube can be deformed and formed, along with being limited to small wefts of hair which are directly connected to the crimped area.

It is clear that conventional hair extensions are not designed for easy construction, cleanliness, reuse and ease of application. Therefore, it would be ideal to address the failings of conventional hair extension systems and methods, while providing a better way of constructing and using hair extensions through a weft and attachment system comprised of a weft with a simple construction and an attachment.

SUMMARY

Hair extensions include a weft and at least a single micro-cylinder, wherein the weft comprises a plurality of hair, a skin weft and at least a single i-tip.

Methods of attaching a hair extension, wherein the hair extension comprises a micro-cylinder, a plurality of hair, a skin weft and at least a single i-tip, include bonding the plurality of hair to form the skin weft and the at least a single i-tip; threading a segment of natural hair through the micro-cylinder; inserting the i-tip into the micro-cylinder; and crimping the micro-cylinder to secure the i-tip.

Hair extensions may also include a weft and at least a single micro-cylinder, wherein the weft comprises a plurality of hair, a skin weft and at least a single i-tip; wherein a top section of the plurality of hair is bonded together to form the skin weft and the at least single i-tip.

BRIEF DESCRIPTION OF THE FIGURES

By way of example only, selected embodiments and aspects of a contemplated embodiment are described below. Each such description refers to a particular figure ("FIG.") which shows the described matter. Each such figure includes one or more reference numbers that identify one or more part(s) or element(s) of a contemplated embodiment.

DETAILED DESCRIPTION

A contemplated hair extension will now be described with reference to an embodiment shown in FIG. 1, which shows a contemplated embodiment of the weft 10.

Figure 1:
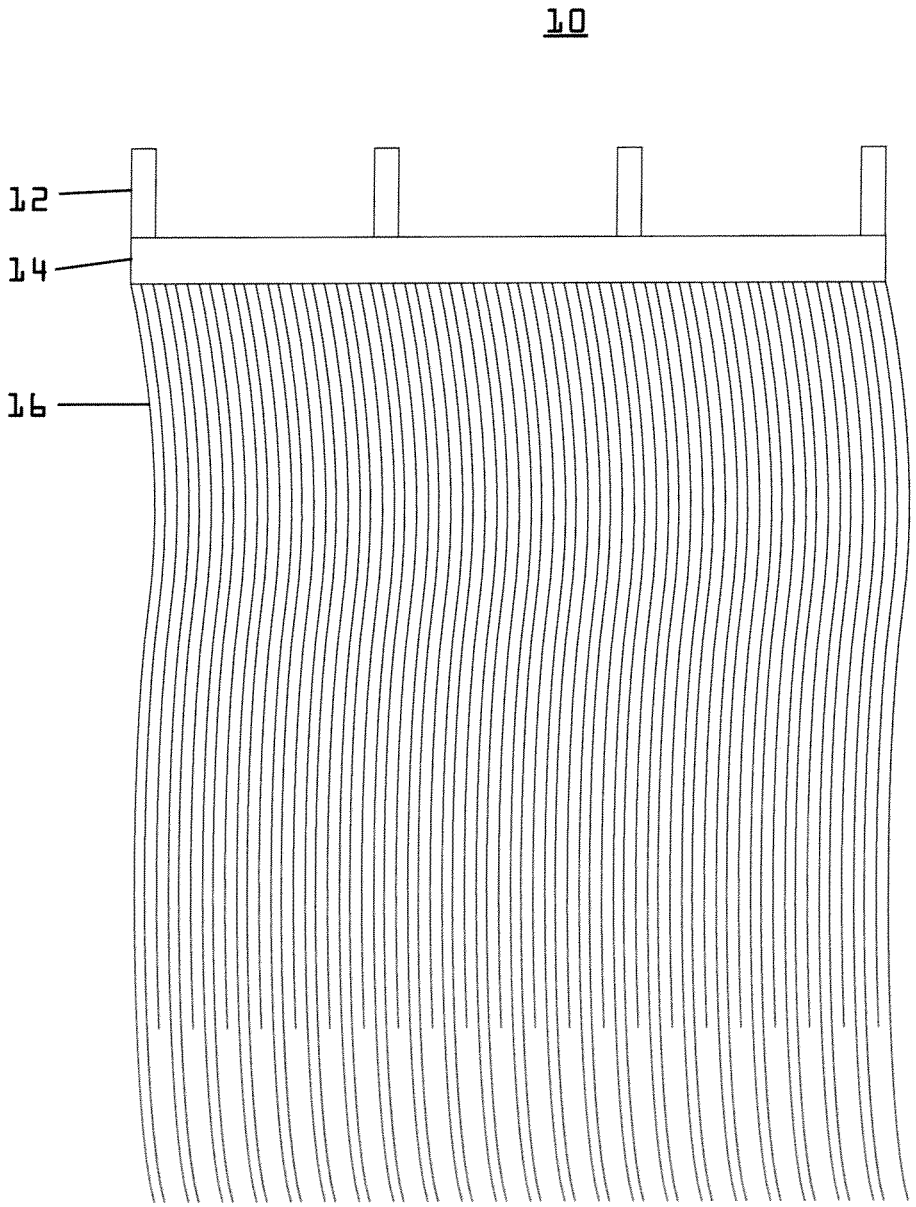
FIG. 1 shows a contemplated embodiment of a weft.

As shown in FIG. 1, the weft 10, comprises artificial hair 16, skin weft 14 and i-tips 12. The artificial hair 16 is either natural or manmade. The artificial hair 16 is arranged in a configuration for a predetermined length and width. The artificial hair 16 is a part of skin weft 14 and i-tips 12. The artificial hair 16 is bonded to the skin weft 14. The i-tips 12 are part of the skin weft 14.

In a contemplated embodiment, the skin weft 14 and i-tips 12 comprise hair 16 that is bonded together to form the skin weft 14 at a location at the topmost edge of the artificial hair 16. The bonding material may be polyurethane or another suitable substance that may bond the hair together. In a contemplated embodiment, portions of the skin weft 14 and thus artificial hair 16 are removed in order to form i-tips 12 and i-tips 12 comprise artificial hair 16 bonded together. In other embodiments, the i-tips 12 may be pieces of artificial hair 16 that are staggered in order to form the i-tips 12 during bonding.

Figure 2:
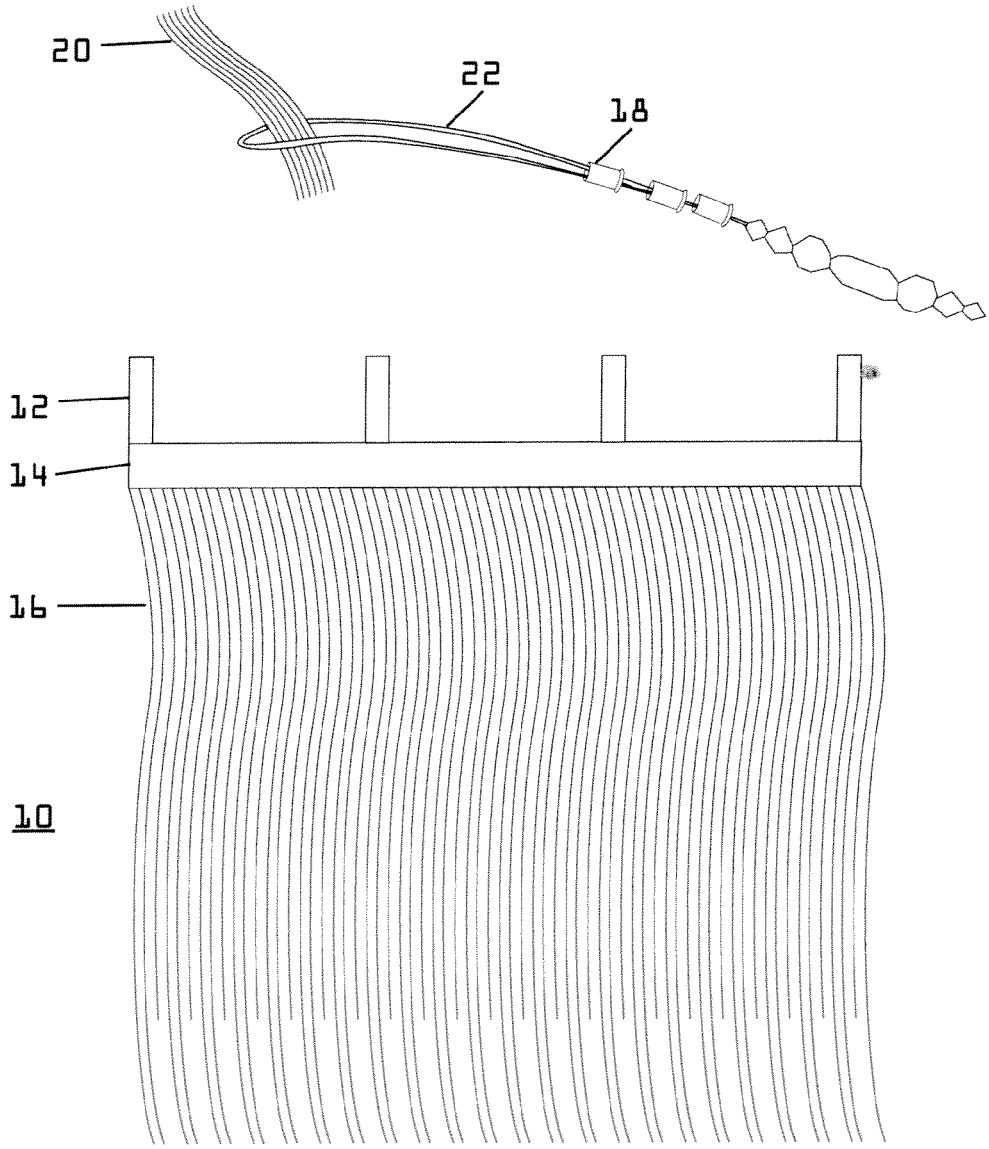
FIG. 2 shows a contemplated embodiment of a weft and micro-cylinder threading tool.

FIG. 2 shows a contemplated weft 10 and the micro-cylinder 18. The micro-cylinder 18 is threaded so that the user's natural hair 20 passes through the micro-cylinder 18. In a contemplated embodiment, a threading tool 22 is used to thread the user's natural hair 20 through the micro-cylinder 18.

Figure 3:
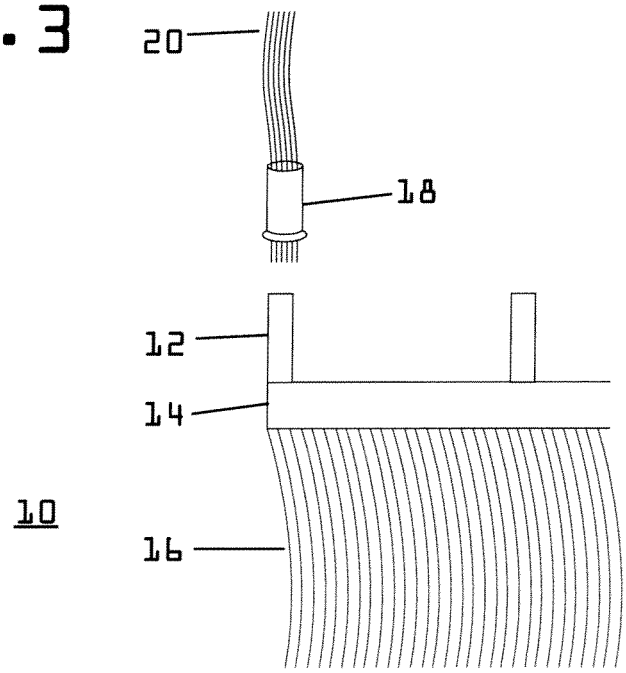
FIG. 3 shows a contemplated embodiment of a weft and micro-cylinder.

FIG. 3 shows a contemplated weft 10 and the micro-cylinder 18. The user's natural hair 20 is threaded through micro-cylinder 18. The i-tip 12 is aligned with the micro-cylinder 18. The i-tip 12 is inserted into the micro-cylinder 18.

Figure 4:
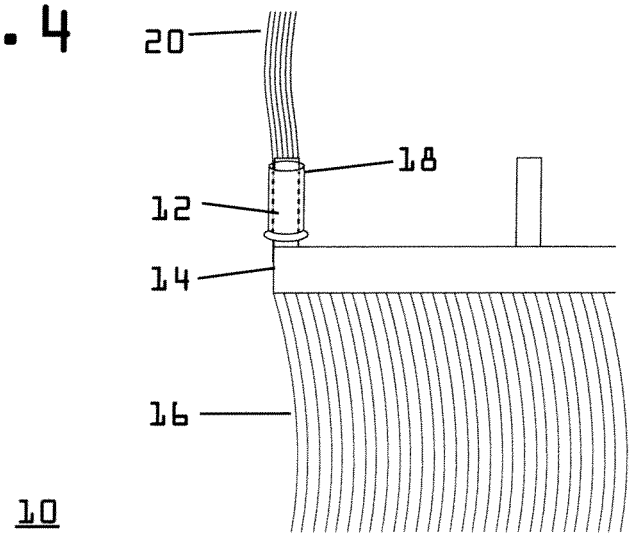
FIG. 4 shows a contemplated embodiment of a weft and micro-cylinder.

FIG. 4 shows a contemplated weft 10 and the micro-cylinder 18. The i-tip 12 is inserted into the micro-cylinder 18.

Figure 5:
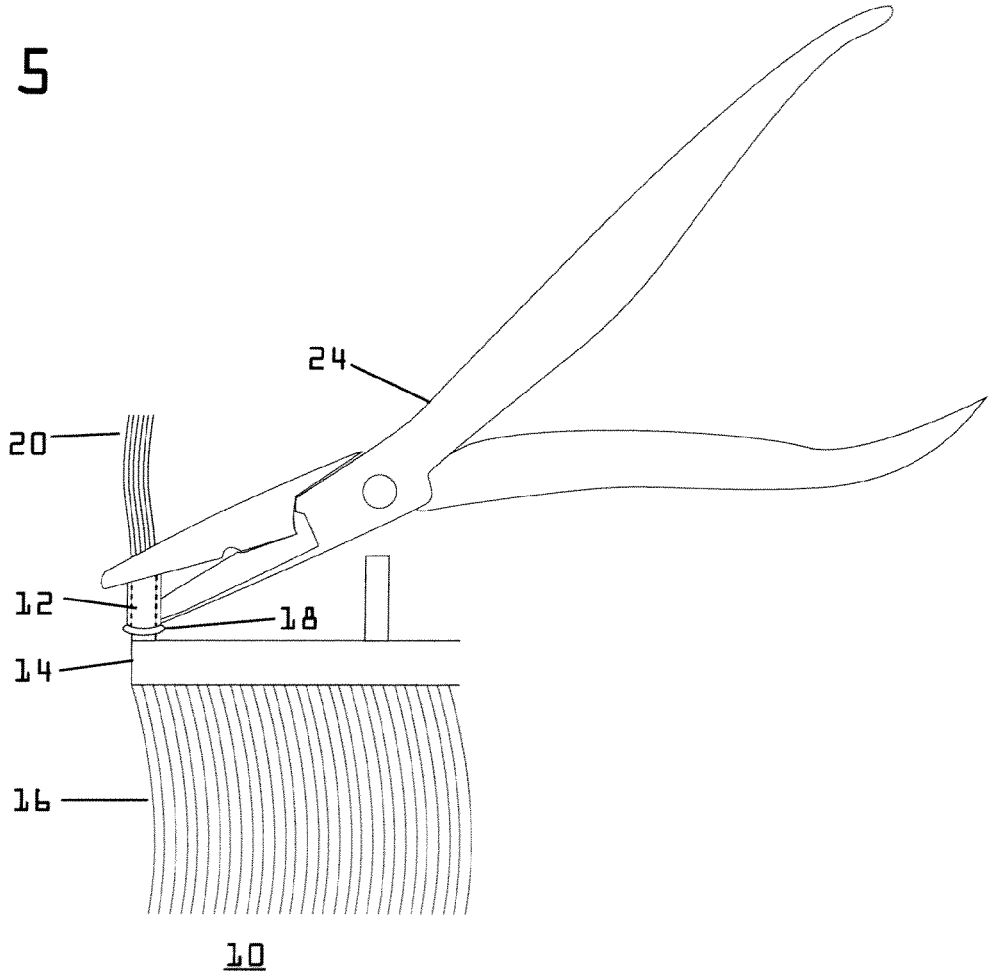
FIG. 5 shows a contemplated embodiment of a weft, micro-cylinder and crimping tool.

FIG. 5 shows a contemplated weft 10, the micro-cylinder 18 and crimping device 24. The i-tip 12 is inserted into the micro-cylinder 18 and the micro-cylinder 18 is crimped using crimping device 24. The crimping device 24 may be any sort of crimping tool such as pliers that may crimp the micro-cylinder 18. The micro-cylinder 18 then secures the user's natural hair 20 to the weft 10 by friction.

The skin weft 14 is typically bonded to the artificial hair 16 by polyurethane or another suitable bonding agent. However, polyvinyl chloride, rubber, thermal plastic rubber or thermoplastic polyurethane or another material may be used to bond skin weft 14 to the artificial hair 16. The i-tip 12 is typically unitary with the skin weft 14, in that they are bonded together or coupled as a single unit, but they may be separate pieces.

Thus, specific embodiments of hair extensions, and methods of attaching the contemplated hair extensions have been disclosed. It should be apparent, however, to those skilled in the art that many more modifications besides those already described are possible without departing from the inventive concepts herein. The inventive subject matter, therefore, is not to be restricted except in the spirit of disclosure herein. Moreover, in interpreting the specifications and claims, all terms should be interpreted in the broadest possible manner consistent with the context. In particular, the terms "comprises" and "comprising" should be interpreted as referring to elements, components, or steps in a non-exclusive matter, indicating that the referenced elements, components, or steps may be present, or utilized, or combined with other elements, components, or steps that are not expressly referenced.

What is claimed is:

1. A hair extension system, comprising:

a hair extension including:

a plurality of hair arranged vertically and having opposed first and second end regions, where the plurality of hair is coupled together at the first end region to create a skin weft and the plurality of hair is divided into first and second subsets;

the first subset having a first end portion which forms part of the coupled first end region of the plurality of hair defining the skin weft, where aligned terminal ends of the first end portion of the first subset define a horizontal edge of the skin weft;

the second subset having a first end portion which forms the remaining portion of the coupled first end region of the plurality of hair defining the skin weft; the first end portion of the second subset of the plurality of hair having terminal ends defining two or more projections spaced horizontally and extending vertically from the horizontal edge of the skin weft in a direction opposite the second end region of the plurality of hair, such that the projections form an uppermost portion of the skin weft and gaps are provided between adjacent projections; and two or more micro-cylinders, each micro-cylinder configured to surround at least a portion of one projection.

2. The hair extension system of claim 1, wherein each projection is integral to the skin weft such that each projection is an extended portion of the skin weft.

3. The hair extension system of claim 1, wherein the skin weft has a width in the horizontal direction transverse to the plurality of hair and a length in the vertical direction aligned with the plurality of hair where the width is greater than the length.

4. The hair extension system of claim 1, wherein the plurality of hair is bonded together at the first end region to form the skin weft.

5. The hair extension system of claim 1, wherein the hairs within each of the projections are bonded together.

6. The hair extension system of claim 1, wherein the skin weft is created by bonding the plurality of hair together at the first end region using polyurethane.

7. The hair extension system of claim 1, wherein at least a segment of the skin weft is removed to form one of the two or more projections.

8. A method of attaching the hair extension of claim 1 to a user, comprising:

threading a segment of natural hair through a first micro-cylinder of the two or more micro-cylinders;

inserting a first projection of the two or more projections into the first micro-cylinder;

crimping the first micro-cylinder to secure the first projection to the segment of natural hair; and repeating the threading, inserting, and crimping steps with a second micro-cylinder of the two or more micro-cylinders, a second projection of the two or more projections, and a second segment of natural hair.

9. A hair extension, comprising:

a plurality of hair arranged vertically and having opposed first and second end portions, where the plurality of hair is bonded together at the first end portion to form a skin weft and the plurality of hair is divided into first and second subsets, the first subset having a first end portion which forms part of the bonded first end portion of the plurality of hairs defining the skin weft and where terminal ends of the first end portion of the first subset are aligned to define a horizontal edge of the skin weft; and the second subset having a first end portion which forms the remaining portion of the bonded first end portion of the plurality of hairs defining the skin weft; the first end portion of the second subset having terminal ends defining two or more projections spaced horizontally and extending vertically from the horizontal edge of the skin weft in a direction opposite the second end portion of the plurality of hair, such that the two or more projections form an uppermost portion of the skin weft and gaps are provided between adjacent projections.

10. The hair extension of claim 9, wherein the first end portion of the plurality of hair is bonded by polyurethane.

11. The hair extension of claim 9, wherein the skin weft, the plurality of hair, and the two or more i-tips projections are unitary.

12. A method of attaching the hair extension of claim 9 to a user, comprising:

threading a first segment of natural hair through a first micro-cylinder; placing a first projection of the two or more projections inside the first micro-cylinder; crimping the first micro-cylinder to secure the first projection to the first segment of natural hair;

threading a second segment of natural hair different from the first segment of natural hair through a second micro-cylinder; placing a second projection of the two or more projections inside the second micro-cylinder; and crimping the second micro-cylinder to secure the second projection to the second segment of natural hair.

13. A hair extension, wherein the hair extension comprises:

a plurality of hair arranged vertically and having opposed first and second end portions, where the plurality of hair is coupled together at the first end portion to form a skin weft and the plurality of hair is divided into first and second subsets;

the first subset having a first end portion which forms part of the coupled first end portion of the plurality of hairs defining the skin weft and where terminal ends of the first end portion of the first subset are aligned to define a horizontal edge of the skin weft; and the second subset having a first end portion which forms the remaining portion of the coupled first end portion of the plurality of hairs defining the skin weft; the first end portion of the second subset having terminal ends defining two or more projections spaced horizontally and extending vertically from the horizontal edge of the skin weft in a direction opposite the second end portion of the plurality of hair, such that the two or more projections form an uppermost portion of the skin weft and gaps are provided between adjacent projections.

14. The hair extension of claim 13, wherein the first end portion of the first subset and the first end portion of the second subset are bonded by polyurethane to create the skin weft.

15. The hair extension of claim 14, wherein only two projections are provided on opposing ends of the skin weft.

16. The hair extension system of claim 1, wherein the horizontal edge of the skin weft defined by the terminal ends of the first subset of the plurality of hair is linear.

* * * * *